United States Patent [19]

Nowisch

[11] 4,092,886

[45] June 6, 1978

[54] METHOD AND APPARATUS FOR SLITTING A CONTINUOUS WEB OF MATERIAL

[75] Inventor: Heinz K. Nowisch, Fulton, N.Y.

[73] Assignee: The Black Clawson Company, Middletown, Ohio

[21] Appl. No.: 806,156

[22] Filed: Jun. 13, 1977

[51] Int. Cl.[2] ..... B26D 1/24

[52] U.S. Cl. ..... 83/56; 83/434; 83/491; 83/500; 242/56.7

[58] Field of Search ..... 83/491–494, 83/308, 425.2, 425, 498, 430, 434, 500–583, 56; 242/56.7

[56] References Cited

U.S. PATENT DOCUMENTS

| | | | |
|---|---|---|---|
| 2,103,790 | 12/1937 | Nason | 242/56.7 X |
| 3,176,566 | 4/1965 | Patterson, Jr. | 83/502 X |
| 3,185,010 | 5/1965 | Printz et al. | 83/503 X |
| 3,685,379 | 8/1972 | Frye et al. | 83/502 X |

*Primary Examiner*—Frank T. Yost
*Attorney, Agent, or Firm*—Biebel, French & Nauman

[57] ABSTRACT

A web slitting apparatus comprises a pair of upper and lower disk shaped web slitting members having their peripheral edges in engagement and disposed for rotation about essentially parallel axes on opposite sides of the web to be slit. The lower web slitting member is driven by a motor having a printed circuit armature. The lower web slitting member and the armature are secured to the motor drive shaft so that when the motor is activated, it directly drives the lower slitting member. The motor is activated only during the initial threading of the winding apparatus to assist in slitting of the web, and during initial acceleration of the web up to the normal line speed, whereupon the motor is deactivated. The web cutting apparatus will thereafter be driven by frictional engagement with the web and continue to slit the web as a web driven slitter.

7 Claims, 7 Drawing Figures

METHOD AND APPARATUS FOR SLITTING A CONTINUOUS WEB OF MATERIAL

BACKGROUND OF THE INVENTION

1. Field of the Invention

The present invention relates to web slitting apparatus, and more particularly, to web driven slitting apparatus for use in conjunction with winding apparatus such as for paper and the like where the web is to be slit lengthwise during winding.

2. Prior Art

Web driven slitters are well known, such as for example the type disclosed in U.S. Pat. No. 3,685,379. They are often used with winding apparatus in which a web of material such as paper or the like is intended to be slit lengthwise during the winding procedure so that the web material can be wound into separate rolls of lesser width than the web material being slit. Such web driven slitters provide a smooth and accurate cut in the web once the web is brought up to its normal line speed.

However, such devices suffer from a common deficiency in that when the winding operation of the web material is initially begun, i.e. during the transient phase between initial threading of the web on to the spindle of the winding machine and the time at which the web is brought up to line speed, such slitters generally do not attain the same peripheral edge speed as the speed of the web, thus often resulting in tearing of the web. This produces a portion of the web which is unsatisfactory for subsequent use. Also, when the web is first fed through such web driven slitters, it may not initially be cut at all since the cutting capability of some of the devices is dependent upon the velocity of rotation of the cutters and the line speed of the web. In such cases, it then becomes necessary for the operator of the winding apparatus to slit the web by some other means, which also usually results in substantial waste of material until the winding apparatus is up to speed.

SUMMARY OF THE INVENTION

The present invention overcomes the above described difficulties and disadvantages associated with such prior art web driven slitting apparatus by providing a web slitting device which is motor driven during start-up of the winding and slitting process, but which is driven by the web once the web has been brought to the normal line speed.

This is accomplished by providing a web slitting apparatus which comprises a pair of upper and lower discshaped web slitting members having peripheral edges in engagement and disposed for rotation about parallel axes on opposite sides of the web to be slit, with one of the web slitting members being driven by a low inertia motor such as a motor having a printed circuit armature. Preferably the lower web slitting member is motor driven and is secured to a drive shaft also secured to and driven by the armature so that when the motor is activated, it directly drives the lower slitting member. The motor is activated only during initial threading of the winding apparatus to assist in slitting of the web, and during initial acceleration of the web to the normal line speed, whereupon the motor is deactivated. The web cutting apparatus will thereafter be driven by frictional engagement with the web and continue to slit the web as a conventional web driven slitter.

A low inertia armature such as a printed circuit armature which forms part of the drive motor for the lower slitter member is an essential part of the present invention, since it reduces the inertia of the rotating members on the lower slitter assembly sufficiently that when the motor is disengaged, the rotating portions can continue to be rotated by frictional engagement with the surface of the web being slit. With conventional drive motors having conventional armatures, this is not possible due to the relatively high inertia of such armatures. Use of conventional motors for intermittently driving a slitter member requires a relatively expensive clutching mechanism or other means for disengaging the drive motor from the slitter in order to permit the slitter to continue slitting the web by engagement therewith.

Therefore, it can be seen that by utilizing web slitting apparatus of the present invention, the advantage of both the web driven slitter and the motor driven slitter are combined while the disadvantages have been eliminated or overcome.

DETAILED DESCRIPTION OF THE PREFERRED EMBODIMENT

Figure 1:
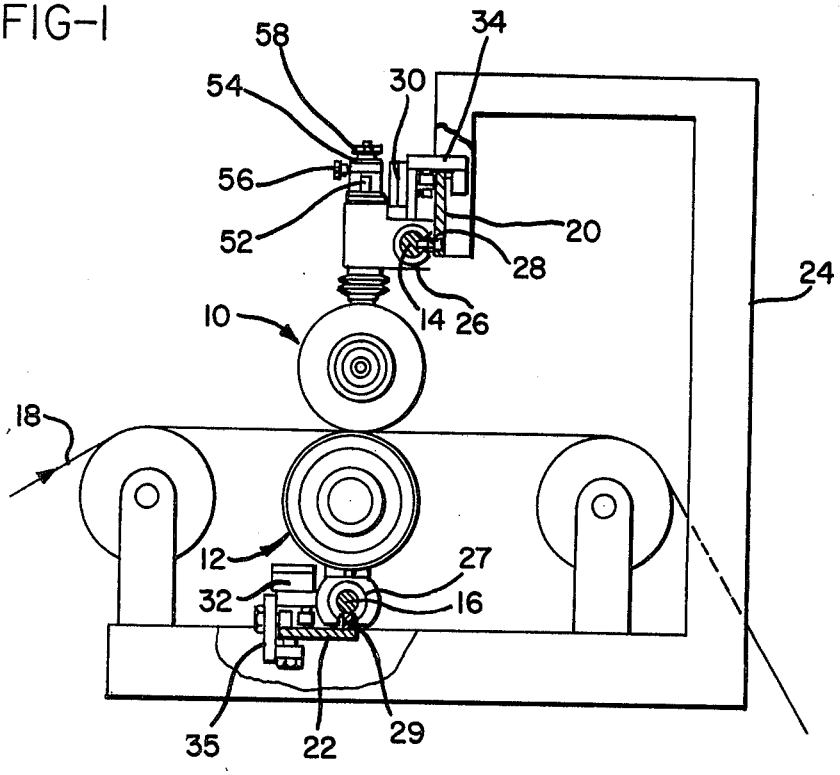
FIG. 1 is a side elevational view of the preferred embodiment of the present invention mounted on the input side of a winding apparatus.
Figure 2:
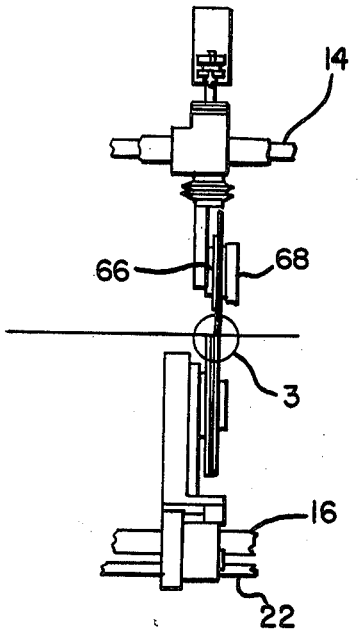
FIG. 2 is a front elevational view of the embodiment illustrated in FIG. 1 and a portion of the winding apparatus.

The preferred embodiment of the web driven slitter of the present invention as illustrated in FIG. 1 basically comprises an upper slitter assembly 10 and a lower slitter assembly 12. The slitter assemblies 10 and 12 are illustrated in FIG. 1 as secured to bars 14 and 16 which extend transversely of the winding machine in parallel relation on opposite sides of the web of material 18 being slit and wound. The circular cross section bars 14 and 16 are each supported along one side by L-shaped support brackets 20 and 22, respectively. L-shaped support brackets 20 and 22 are in turn secured to a mounting frame 24 forming a portion of the web winding apparatus (not shown in its entirety).

Each of the upper and lower slitter assemblies 10 and 12 is supported on bars 14 and 16 by cylindrical brackets 26 and 27 respectively of generally C-shaped cross section each having an open outer portion 28 and 29 respectively, so as to form the C-shaped cross-section which permits the foot portion of L-shaped brackets 20 and 22 to support bars 14 and 16 with the mounting brackets 26 and 27 being able to ride along the bars 14 and 16. In other words, the mounting brackets 26 and 27 are somewhat horsehoe-shaped so as to permit them to be slid along the length of the bars 14 and 16 without interference from L-shaped brackets 20 and 22.

Secured to the side of each of the mounting brackets 26 and 27 adjacent the leg portions of L-shaped support brackets 20 and 22 are clamping assemblies 30 and 32 which are utilized to hold the upper and lower slitter assemblies 10 and 12 in a desired position along bars 14 and 16 on each side of the web 18. Clamping assemblies 30 and 32 permit the upper and lower slitter assemblies 10 and 12 to be moved manually transversely across the surface of the web so that the desired width of slit web can be achieved and altered if necessary.

Each of the clamping assemblies 30 and 32 has a generally U-shaped bracket 34 and 35, respectively, which encompasses the end portion of the leg of each L-shaped support bracket 20 and 22 remote from the foot portion of the bracket which supports the bars 14 and 16. One side of each of the generally U-shaped brackets 34 and 35 is secured to the cylindrical mounting brackets 26 and 27, respectively.

Figure 4:
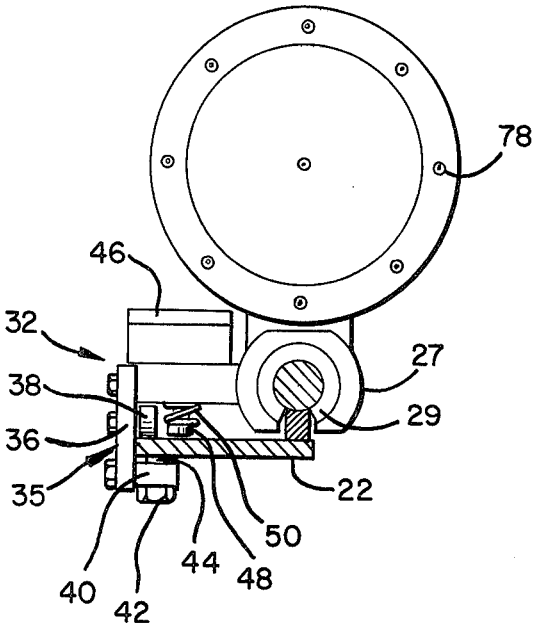
FIG. 4 is a side elevational view of the lower slitter assembly of the embodiment illustrated in FIG. 1.
Figure 5:
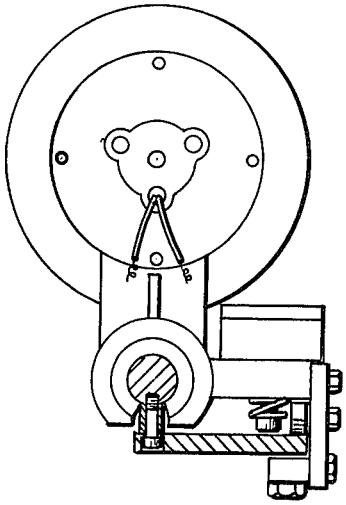
FIG. 5 is a side elevational view of the opposite side of the lower slitter assembly as that illustrated in FIG. 4.

Brackets 34 and 35 are of identical construction and therefore only one will be described. The central portion 36 of U-shaped bracket 35, for example, as best seen in FIGS. 4 and 5, supports a roller 38 rotatably mounted to the inside of the central portion 36, which rides on the upper surface of the leg portion of L-shaped support bracket 22. On the side 40 of the U-shaped bracket 35 opposite the side secured to cylindrical mounting bracket 27 is secured a flat bottom bolt 42, the outer end 44 of which rides on the opposite surface of the L-shaped bracket 22 from roller 38. Thus, roller 38 and the top side of L-shaped bracket 22 in connection with bar 16 act as guides for the U-shaped bracket 35 for movement along the leg portion of the L-shaped support bracket 22 when the lower slitter assembly 12 is moved transversely of the web 18.

The side of the U-shaped bracket 35 which supports bracket 27 also supports clamping assembly 32 which comprises an actuator assembly 46 used to move a plunger 48 vertically to disengage it from the surface of the leg portion of the L-shaped support bracket 22 opposite the side contacted by the outer end 44 of bolt 42. The plunger 48 is normally held engaged with the surface of the support bracket 22 by a biasing spring 50 having sufficient force to hold the lower slitter assembly 12 in a desired position along bar 16 during slitting of the web 18.

In order to move the slitter assembly 12 along the bar 16, the actuator 46 is activated to move the plunger 48 vertically upward. The actuator assembly 46 holds plunger 48 in its uppermost position during realignment of the lower slitter assembly 12 along the surface of the web. Once the slitter assembly 12 has been properly located, actuator assembly 46 is deactivated so as to permit plunger 48 to be biased by spring 50 against the surface of the L-shaped support bracket 22.

Actuator assembly 46 can be a mechanical, hydraulic, pneumatic or solenoid device, whichever is desired. However, it must be capable of supplying sufficient force to overcome bias spring 50 to disengage the plunger 48 from the surface of bracket 22 and to hold the plunger in its uppermost position during realignment of the slitter assembly.

Each of the slitter assemblies 10 and 12 is generally secured to its respective support bars 14 and 16 in the manner described above in connection with the lower slitter assembly. However, the upper slitter assembly 10 has, in addition, a means for adjusting the vertical movement of the slitter blade relative to the lower slitter blade. In the upper slitter assembly illustrated, this vertical adjustment is simply provided by utilizing a slide bar 52 to which the slitter blade is secured at its lowermost end.

The slide bar extends through a support bracket 54 containing a biasing screw 56 that permits the slide bar 52 to be held in any desired position merely by tightening the biasing screw and thus forcing the slide bar against the side of support bracket 54. A metering adjustment nut 58 is provided on the upper threaded end portion of the slide bar 52 for a finer adjustment of the relative position between the two slitter blades.

Figure 3:
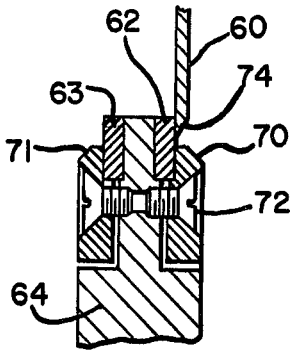
FIG. 3 is a cross sectional view of the portion of the embodiment of FIG. 2 within the circle designated 3.

By providing this vertical adjustment in the upper slitter assembly 10, the upper slitter blade 60 can be brought into proper vertical alignment with either of the lower blades 62 or 63 in order to slit the web 18. The upper and lower slitter blades are somewhat different, as best seen in FIG. 3, with the upper slitter blade 60 basically comprising a cylindrical disk with a relatively small central opening, while the lower slitter blades 62 and 63 are each more in the shape of a ring supported by a cylindrical backing member 64. The slitter blades are preferably made of a hard durable metal so that they do not wear down rapidly due to the cutting of the web.

On the other hand, the backing member 64 is preferably made of a much lighter material, such as aluminum, in order to reduce the inertia of the rotating portion of the lower slitter assembly 12. It is desirable to maintain the lowest possible inertia of the rotating portion of the upper and lower slitter assemblies in this preferred embodiment since the slitters are driven by the web during a major portion of the cutting operation and thus obtain their rotational movement from the frictional force generated by contact with the web. If their inertia were high enough, due to substantial weight, the web would not generate sufficient frictional force to rotate the slitters.

In addition, during the acceleration period of the rotating portion of the lower slitter assembly 12, it could not be as easily or quickly accelerated if the inertia of this rotating portion were high. Thus, it is desirable to maintain the lowest possible inertia in the rotating portions of both of the slitter assemblies while still maintaining sufficient rigidity in the assemblies to produce a smooth even slit of the web.

The upper slitter blade 60 is secured for rotation in a bearing assembly to the lower portion of slide bar 52 in order to reduce as much as possible the rotational friction due to mounting. Slitter blade 60 is laterally supported in its central portion by a cylindrical backing plate 66 and a front cover plate 68. The front cover plate is secured to backing plate 66 with a nut which extend through the slitter blade, to provide additional rigid support to the slitter blade.

The lower slitter blades 62 and 63 are each supported in a groove formed on opposite sides of cylindrical backing member 64 and are held in the grooves by ring shaped members 70 and 71 secured in place by a plurality of bolts 72 which cause the back surface of the members 70 and 71 to hold the slitter blades 62 and 63 against the backing member 64.

As can best be seen in FIG. 3, the upper slitter blade 60 preferably has a beveled outer peripheral edge 74 while the cross sectional shape of the lower slitter blades 62 and 63 is rectangular. Slitter blade 60 is so secured to backing plate 66 that the beveled edge rides against the side portion of either of the lower slitter blades 62 or 63 and is usually positioned so that the upper slitter blade 60 is biased slightly against the surface of either of the lower slitter blades. This provides a sharp cut of the web 18 which would otherwise not be possible if the blades were slightly separated.

The cylindrical backing member 64 which supports the lower slitter blades 62 and 63 is rotatably secured to a horizontally exposed drive shaft 76. It is secured to the drive shaft 76 by one bolt 78 for driven rotation therewith. The drive shaft 76 is driven by a motor assembly, two alternative forms of which are described below.

Figure 6:
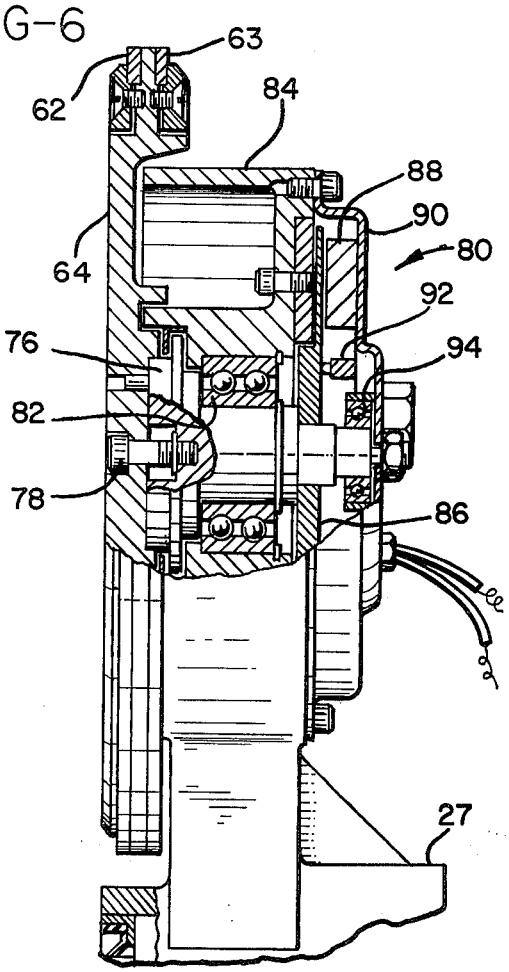
FIG. 6 is a first alternative embodiment in partial cross section of the internal construction of the lower slitter assembly illustrated in FIGS. 4 and 5.

A first alternative form of motor assembly 80 is illustrated in FIG. 6. In this embodiment, drive shaft 76 is mounted in a bearing assembly 82 supported in a motor housing 84. A printed circuit armature 86 is secured to drive shaft 76 for rotation therewith on the opposite side of the bearing assembly 82 from the backing member 64. The printed circuit armature 86 is a very important part of the present invention in that it permits the armature to be made much lighter than conventional wire wound armatures.

This makes the use of the present invention practically possible in that it permits the armature to have sufficiently low inertia that the armature, drive shaft and rotating portion of the cutter assembly can be driven by the frictional force created by engagement with the web. This allows the slitter to be what is referred to in the trade as a web driven slitter, once it has been accelerated by the motor to the line speed of the web. This eliminates the need for intricate clutching mechanisms to disengage an auxiliary motor or the waste of web as conventional web driven slitters are being accelerated by the web up to the line speed.

Such a printed circuit motor, including the printed circuit armature 86 and the other components described below can be obtained, for example, from the Printed Motors Division of Kollmorgan Corporation, Glencover, New York. Since a variety of operating characteristics of such printed circuit motors are available and the desirable features will depend upon the particular application, details of a particular printed circuit motor will not be provided herein.

Referring further to the embodiment of the motor assembly 80 illustrated in FIG. 6, a cylindrical field magnet 88 is supported on one side of the printed circuit armature 86 by a removable housing portion 90. Also supported by removable housing portion 90 are a plurality of brushes 92. Both the field magnet 88 and the brushes 92 function in the same manner as conventional motors. The main distinction of printed circuit motors utilized in the present invention from the prior art motors is in the use of a printed circuit armature 86 which, as mentioned above, provides an armature with a much lower inertia than such conventional motors.

An additional bearing assembly 94 is provided to add support to drive shafts 76 and is mounted to the removable housing portion 90. As seen in FIG. 6, the lower portion of motor housing 84 is secured to the cylindrical mounting bracket 27 or is formed therewith as a part of a casting.

Figure 7:
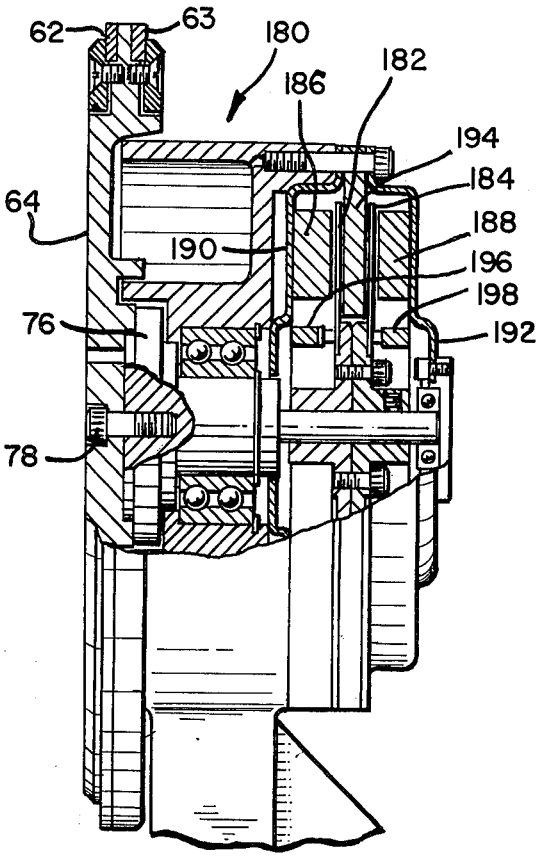
FIG. 7 is a second alternative embodiment in partial cross section of the lower slitter assembly illustrated in FIGS. 4 and 5.

Referring now to FIG. 7 which illustrates the second alternative embodiment of a motor assembly 180, it is very similar to motor assembly 80 except for the differences described below. The main distinction between the embodiment 180 and the embodiment 80 is that the embodiment 180 has two printed circuit armatures 182 and 184 as opposed to the one in embodiment 80. Although the second printed circuit armature adds somewhat to the inertia of the rotating assembly, it also provides additional torque characteristics, which in some installations is sufficiently desirable to offset the disadvantage of having the additional inertia due to the increased weight.

Both of the armatures 182 and 184 are secured to the drive shaft 76. Cylindrical steel magnets 186 and 188 are respectively secured to removable housing portions 190 and 192 on opposing sides of the printed circuit armatures 182 and 184. A cylindrical armature-separating member 194 is secured to the motor housing between armatures 182 and 184.

A plurality of brushes 196 and 198 are secured to removable housing portions 190 and 192, respectively, adjacent each of the printed circuit armatures 182 and 184 and operate in conjunction with the field magnets 186 and 188 as conventional field magnets and brushes operate. With these noted exceptions, the motor assembly 180 illustrated in FIG. 7 will otherwise be constructed and function the same as motor assembly 80 illustrated in FIG. 6.

The alternative assembly illustrated in FIG. 7 can be considered a more heavy duty motor assembly than that illustrated in FIG. 6 and can be utilized for the provision of additional torque if necessary, such as in the cutting of relatively thick web material or where a higher rate of acceleration is desirable in order to bring the rotating assembly to the line speed of the web faster than would be the case with the embodiment illustrated in FIG. 6.

In operation, either a single set of upper and lower slitter assemblies 10 and 12 may be utilized on a winding apparatus, or a plurality of sets of slitter assemblies may be secured to the support bars 14 and 16 so as to produce a plurality of separate web portions by slitting a large web 18 into a plurality of separate strips. In any event, regardless of whether a single set of slitter assemblies, or a plurality of such slitter assemblies are used the operating procedures are essentially the same. The slitter assemblies 10 and 12 are manually located at the desired position relative to the web and are then clamped in place with clamping assemblies 30 and 32 as described above by activation of the hydraulic, pneumatic or solenoid control system (not shown).

If the slitting blades 60 and 62, for example, are not in the proper relationship as illustrated in FIG. 3, the upper slitter blade is lowered vertically by adjustment of the slide bar 52 in the manner described above, to bring the upper slitter blade 60 into contact with the side surface of the slitter blade 62. Also, the upper slitter assembly 10 is positioned so that the upper slitter blade 60 is slightly biased against the side of the lower slitter blade 62 and held in that position by clamping means 30.

The printed circuit motor which drives the lower web slitter 12 is than activated to accelerate the lower slitter blade. Due to the contact between the upper and lower slitter blades 60 and 62, the upper slitter blade 60 will likewise be accelerated. Once the slitter blades 60 and 62 are rotating, the web 18 is threaded through the web slitting assemblies and onto the takeup drums of conventional winding apparatus (not shown). By causing the rotation of slitter blades 60 and 62 before beginning threading of the web on the windup drum, the web will be properly slit at its beginning, contrary to the condition that is generally present with conventional web driven slitters.

The winder is then activated and the web brought up to line speed. The rotational speed of the rotating portions of the slitter assemblies 10 and 12 should be approximately the same as the line speed of the web at this time. The printed circuit motor is then deactivated, and the slitters are then driven by frictional engagement with the web as with conventional equipment except that in the present invention, the armature and drive shaft of the slitter drive motor rotate with the slitter blade in direct engagement therewith. Thus, it can be seen that the difficulties associated with conventional web driven slitting apparatus are overcome by the present invention and that the advantages of a web drivens-slitter and of a motor driven slitter have been combined in the present invention to provide an efficient and economically reasonable means of slitting the web.

Although the foregoing description illustrates the preferred embodiment of the present invention, other variations are possible. For example, although the foregoing description of the preferred embodiment refers to upper and lower slitting assemblies with the lower assembly being motor driven, the invention is not intended to be limited to such an arrangement, since the upper slitting assembly could be motor driven rather than the lower, or both slitter assemblies could be disposed in horizontal rather than vertical alignment. All such variations as would be obvious to one skilled in this art, are intended to be included within the scope of the invention as defined by the following claims.

What is claimed is:

1. A web slitting device, comprising:

upper and lower mating slitting members, one of said members having a web cutting peripheral edge portion and the other of said members having a peripheral edge bearing portion in contact with said cutting peripheral edge portion of said one member; and motor means for rotatably driving one of said members, said motor means including an armature secured to a motor drive shaft adapted for driving engagement with said driven member, said upper and lower slitting members and said armature having sufficiently low inertia to effect driving of said slitting members by frictional engagement with said web when said motor means is deactivated.

2. A web slitting device as defined in claim 1 wherein said armature is a printed circuit armature.

3. A web slitting device as defined in claim 2 wherein the member driven by said motor means is the lower member.

4. A web slitting device as defined in claim 3 wherein:

said upper member includes a circular disc having said web cutting peripheral edge portion;

said lower member includes a circular disc having said bearing portion; and both said discs are rotated about essentially parallel axes perpendicular to the direction of movement of a web being slit, said web passing between said discs so as to be slit thereby.

5. A web slitting device for use in lengthwise slitting of a web of material as it is being wound on a winding apparatus, comprising:

a pair of upper and lower disc-shaped web slitting members disposed for rotation on essentially parallel axes on opposite sides of the path of movement of said web, and having their peripheral edge portions in web cutting engagement with one another;

said upper web slitting member being mounted for free rotation about its axis and driven by frictional engagement with said web and said lower web slitting member;

motor means for intermittently drivingly engaging said lower web slitting member, having a printed circuit armature fixedly secured to a drive shaft supporting said lower web slitting member for rotation therewith; and said motor means being operable to bring the speed of the peripheral edge portion of said lower web slitting member up to substantially the same speed as movement of said web, said lower web slitting member and said armature being drivable by frictional engagement of said lower web slitting member with said web upon disconnecting of said motor means after said speed has been attained.

6. A method of lengthwise slitting a continuous web of material utilizing upper and lower disc-shaped web slitting members disposed on opposite sides of said web with their peripheral edge portions in engagement with one another where said web passes therebetween, said lower web slitting member being driven by a motor means having an armature mounted on a drive shaft also supporting said lower web slitting member, said method comprising the steps of:

activating said motor means for a sufficient time to bring said outer peripheral edge portion of said lower web slitting member up to substantially the same speed as movement of said web;

deactivating said motor means;

continuing to drive both said upper and lower web slitting members so as to slit said web by frictional engagement between said slitting members and said web.

7. A method as defined in claim 6 and further including prior to said activating step the step of:

activating said motor to drive said lower web slitting member when said web is initally being threaded on a winding apparatus.

* * * * *